US007143972B2

(12) United States Patent
Finnøy

(10) Patent No.: US 7,143,972 B2
(45) Date of Patent: Dec. 5, 2006

(54) DRIVING DEVICE FOR A CABLE REEL ASSEMBLY

(75) Inventor: Steinar Finnøy, Molde (NO)

(73) Assignee: I.P. Huse AS, Harøy (NO)

( * ) Notice: Subject to any disclaimer, the term of this patent is extended or adjusted under 35 U.S.C. 154(b) by 135 days.

(21) Appl. No.: 10/860,167

(22) Filed: Jun. 3, 2004

(65) Prior Publication Data

US 2004/0256512 A1 Dec. 23, 2004

(30) Foreign Application Priority Data

Jun. 3, 2003 (NO) ..... 20032505

(51) Int. Cl.
*B65H 27/00* (2006.01)

(52) U.S. Cl. ..... 242/397.2; 242/548; 242/615.2

(58) Field of Classification Search ..... 242/397, 242/397.2, 397.3, 397.5, 548, 548.1, 566, 242/615, 615.2
See application file for complete search history.

(56) References Cited

U.S. PATENT DOCUMENTS

| | | | | |
|---|---|---|---|---|
| 523,577 | A * | 7/1894 | Ivens | 242/397.3 |
| 537,731 | A * | 4/1895 | Stevens | 242/397.3 |
| 913,564 | A * | 2/1909 | Riblet | 242/397.3 |
| 1,957,994 | A * | 5/1934 | Eccher | 242/397.2 |
| 2,211,299 | A * | 8/1940 | Smith | 242/397 |
| 2,662,703 | A * | 12/1953 | Brown | 242/397.3 |
| 3,347,490 | A * | 10/1967 | Browning | 242/397.3 |
| 3,568,946 | A * | 3/1971 | Anderson et al. | 242/397.5 |

FOREIGN PATENT DOCUMENTS

EP 0 518 853 * 6/1992

* cited by examiner

*Primary Examiner*—William A. Rivera
(74) *Attorney, Agent, or Firm*—Rodman & Rodman

(57) ABSTRACT

The present invention is related to guiding cable, wire, chain etc. (7) on to a cable drum, orderly and layered, such that the moments of force experienced by the device according to the present invention is minimized thereby providing a simpler design that is cheaper to manufacture and maintain.

7 Claims, 3 Drawing Sheets

DRIVING DEVICE FOR A CABLE REEL ASSEMBLY

Figure 1A:
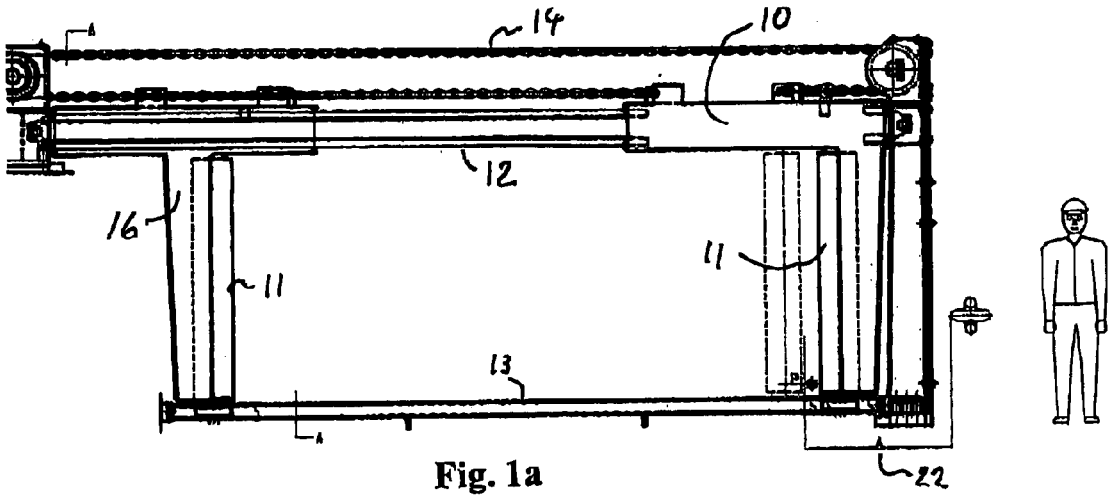

The present invention is generally related to a method and device for guiding a cable, wire, rope, line, chain, string etc. by winching on to a cable drum, and specially related to an arrangement of a cable reel assembly for accumulating said cable, wire, rope, line, chain, string etc. onto said drum by winching according to the appended claim 1.

Accumulating wire, rope, chain etc. onto a cable drum is commonly used for example when loading and unloading cargo from a ship. The wire or rope etc. is usually guided over a pulley or similar device provided in one end of an arm wherein the cargo may be fastened to the wire or rope etc. with the help of a hook or similar device. In an opposite end of the arm, there is a motor driven drum collecting or releasing said wire or rope etc. thereby providing means for lifting or lowering the cargo. The arm is usually revolving around one or more axes providing a possibility to move the cargo for example to/from a ship to/from a pier. The cable drum has a certain width and diameter comprising edges in each end of the drum adjusted to provide enough space for the wire or rope etc. when fully collected onto the cable drum. The wire or rope must usually be collected orderly and layered to provide enough space on the cable drum.

There will be an angle between the pulley at one end of the arm and the cable drum at the other end of the arm. To be able to winch the wire or rope orderly and layered on to the cable drum, there is usually means for guiding the wire or rope on to tho cable drum. The prior art solution is to provide a moving carriage device moving back and forth in front of the receiving end of the cable drum controlling the movement of wound cable on to the cable drum, thereby providing an orderly and layered winching of the cable. The moving carriage device is usually electrically or hydraulically driven. The angle between the cable, wire or rope etc. and the cable drum forms a moment of force that may be huge when the cargo is heavy. This moment of force will be transferred to the moving carriage. Therefore these arrangements must be solid, and therefore expensive to manufacture when applied with heavy cargo loads as round with cranes on board ships etc. The huge moment of force may also provide wear and tear of the arrangement thereby causing severe maintenance problems and repair costs of the cable reel assembly.

U.S. Pat. No. 1,935,585 disclose an arrangement for a bobbin winder comprising a metal sheet with an appropriate hole in the middle of the sheet providing guiding means for a cable, wire, rope etc. when being winched on to a drum. The metal sheet is attached movable to an upper and lower guiding beam. The winding movement of the drum is transferred to a reeving movement of the metal sheet via properly arranged cogwheels. The upper and lower guiding reels for the metal sheet picks up the moment of force. U.S. Pat. No. 2,662,703 disclose an aperture provided by rods as the guiding means for the cable, wire, rope etc. in a cable drum assembly. The rods forming the guiding aperture are supported by one single lower guiding reel driven back and forth by an endless chain mechanism. The moment of forces is picked up by the single guiding reel. U.S. Pat. No. 5,330,122 discloses a similar cable drum in assembly comprising a reeving carriage attached hanging on support wheels on an upper support rail. An endless chain drives the carriage back and forth above the receiving side of the cable drum. The reeving carriage and the support rail picks up the moment of forces.

Figure 1B:
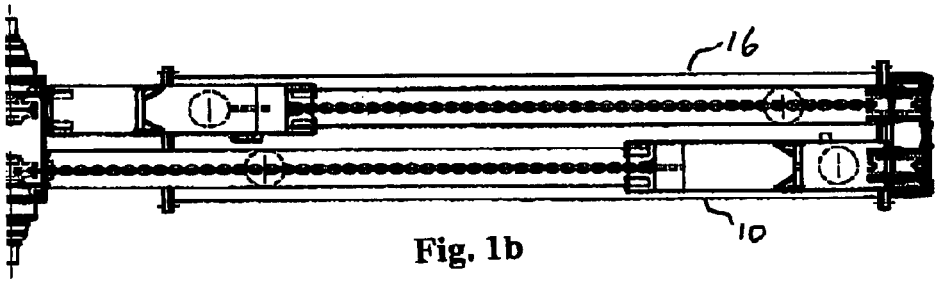

FIG. 1 discloses an example of prior art close to the present invention. A guiding carriage 10 and 16 is arranged with guiding reels 11. As illustrated in FIG. 1, the cable, wire, rope etc. is entering the arrangement perpendicular to the drawing surface, which is the receiving side of the cable drum assembly, and wherein a cable drum (not shown) is located behind the illustrated guiding carriage assembly, the axis of rotation of the cable drum being orthogonal to the axis of guiding reels 11. An arrangement of chains 14 drives the guiding carriage 10 and 16 along guiding rails 12 and 13. FIG. 1*b* illustrates the guiding carriage 10 and 16 seen from above.

The guiding carriage 10 and 16 picks up the moments of force when winching. The dimension C pointed to by the numeral 18 must have a certain length compared to the height B pointed to by numeral 19. The relation between C and B is that the greater the ratio between B:C, the greater the forces P3 and P4 are, numerals 20, 21, respectively. If the moment of force is too high, the guiding carriage 10, 16 will lock because of the frictional forces between the guiding carriage 10, 16 and the guiding rail 12 and/or the guiding rail 13.

Figure 1C:
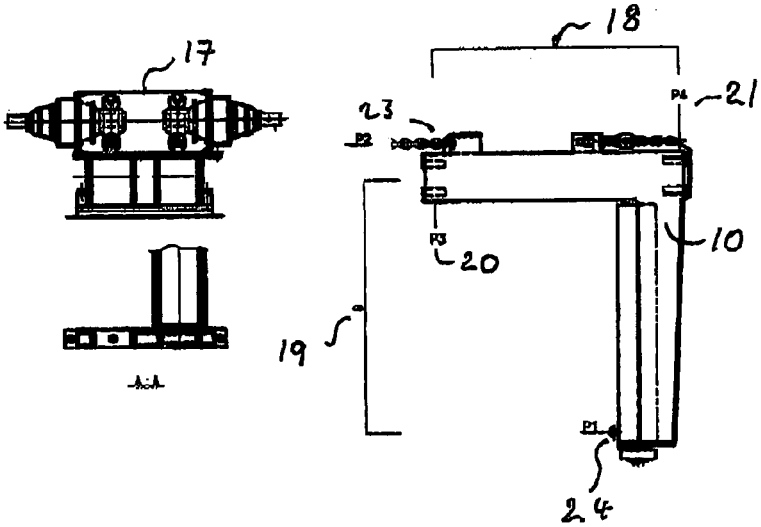

The tractive power in the chain 14 illustrated as the force P2, numeral 23 must be increased to maintain necessary power P1, numeral 24, for winching the wire etc. If the dimension C, numeral 18, is huge the dimension A, numeral 22. must also be increased. It is preferred to have as small a dimension A as possible to provide space for chains moved over a chain wheel or gypsy, for example. FIG. 1*c*, numeral 17, illustrates such an example.

During operation, the cable, wire, rope, chain etc. will be moved by the movement of the guiding reel 11 over the receiving side of the cable drum assembly. As seen from the figure, the cable, wire, rope, chain etc. may be moved along the axis of the guiding reel 11, also. It is therefore possible that a huge moment of force is provided by the distance formed between the point of engagement of the wire on to the guiding reel 11 and the guiding carriage farthest off.

The main problem in the prior art is that the guiding carriage and guiding reels must be strong and solid assemblies to provide for the potentially huge moments of force experienced under lifting and lowering of for example heavy cargo. These arrangements are therefore costly to produce, maintain and repair. In addition, the friction may cause overheating, and individual elements of the cable reel assembly may be pushed out of alignment, which may be a risk for damaging the equipment or the people operating the assembly. To avoid such problems in the prior art, there is a need for extensive maintenance work on the cable drum assembly.

The object of the present invention is to provide a guiding carriage comprising guiding reels that is cheaper to produce, and that is less exposed to moments of force, and therefore cheaper to manufacture and maintain during operation.

FIGS. 1*a*, 1*b*, and 1*c* illustrates prior art.

Figure 2A:
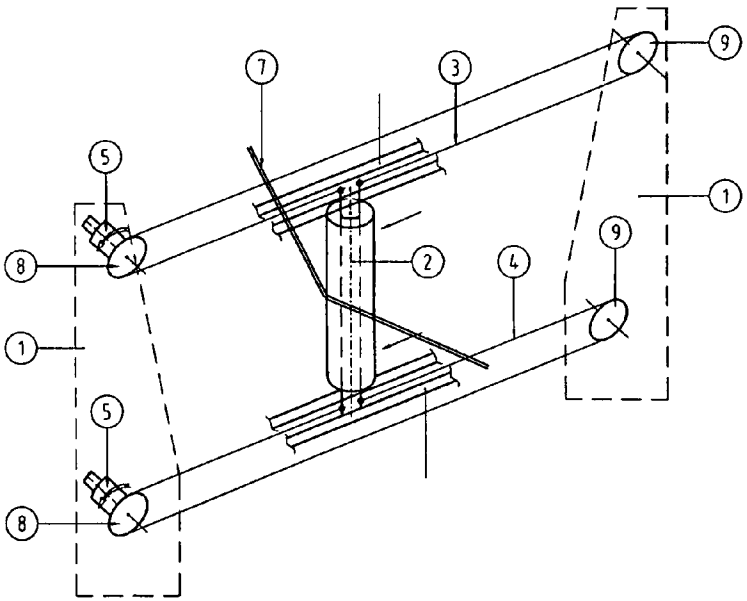
Figure 2:
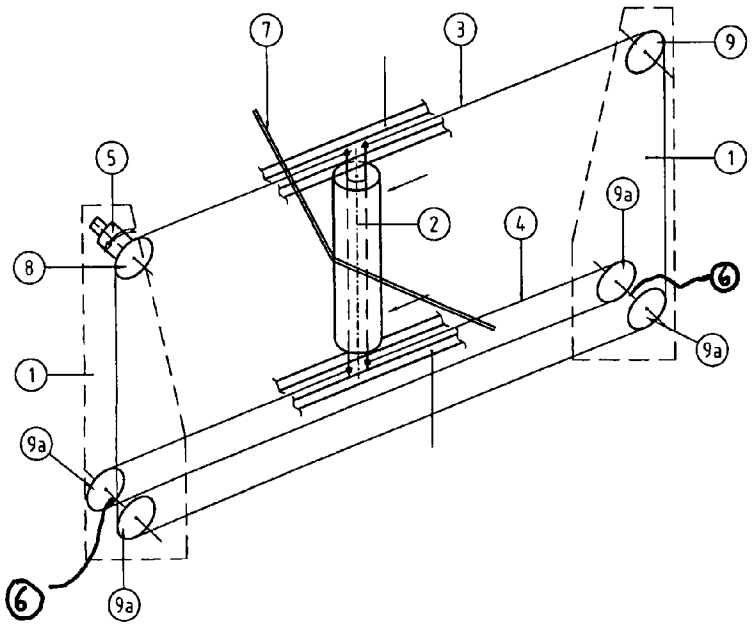

FIGS. 2 and 2*a* depict principle working elements of two embodiments of a guiding reel assembly according to the present invention.

FIG. 3 illustrates an example of embodiment of the present invention.

FIG. 2 depicts the principal manner of operation of a guiding reel assembly according to the present invention. The assembly is mounted on brackets 1 on each side of the assembly. A guiding reel 2 is mounted to driving lines 3 and 4 on a first and second side of the guiding reel 2, respectively, and is pushed back and forth by a driving unit 5 attached to the driving lines 3 and 4.

The driving lines 3 and 4 may be assembled in different manners comprising chain and gypsy, cogged transmission belt with cog wheels, chain and chain wheel, wire and winching drum etc. In the example of embodiment depicted in FIG. 2, each drive line is a continuous loop moving around a turning wheel 9 and driving wheel 8. The drive line 3 is provided in all 4 corners of the assembly while drive line 4 is a loop between the two lower corners provided by the two brackets 1. The drive lines 3 and 4 are coupled together with a mechanical coupling up, for example a common axle 6 such that the upper and lower part of the guiding reel 2 moves in the same manner. In other embodiments of the present invention, the driving lines 3 and 4 may be assembled in the same manner. The driving line 3 can be a loop arranged between the two upper corners provided by the brackets 1, and the driving line 4 can be arranged as a loop between the two lower corners, or the drive lines may be loops covering all 4 corners of the assembly. In another example of embodiment of the present invention, there is a separate driving unit for each driving line 3 and 4. These driving units 5 may coordinate the movements of the attached driving lines respectively by means of electronic motor control, for example, as known to a person skilled in the art.

A guiding reel 2 guides a wire, cable, rope etc. 7 to a preferred position an a cable drum (not shown). More than one guiding reel 2 may be attached to the driving lines 3 and 4 in the same cable drum assembly and/or different guiding reels 2 may be located in systems located adjacent to each other in a row.

According to the present invention, the guiding reel 2 is attached to both driving lines 3 and 4. Thereby reducing or eliminating biasing produced by the moments of force, the possibility of overheating due to friction, jamming, wear and tear etc. since the forces are picked up by both drivelines 3 and 4. This will in its turn make it possible to reduce the dimensions of the guiding rails 12 and 13, and make them as simple profiles supporting simple gliding members functioning as a guiding carriage. The picking up of the forces by the driving lines 3 and 4 provides for a design that can master huge moments of force that otherwise would destroy or cripple the cable reel assembly. Furthermore, the picking up of the forces by the driving lines 3 and 4 makes it possible to produce a simple guiding carrier arranged as simple gliding members, gliding along simple support rails 12 and 13. In this manner, the present invention provides an improved guiding carrier comprising guiding reels that is simpler in design, easier to manufacture and is simpler to maintain.

Figure 3A:
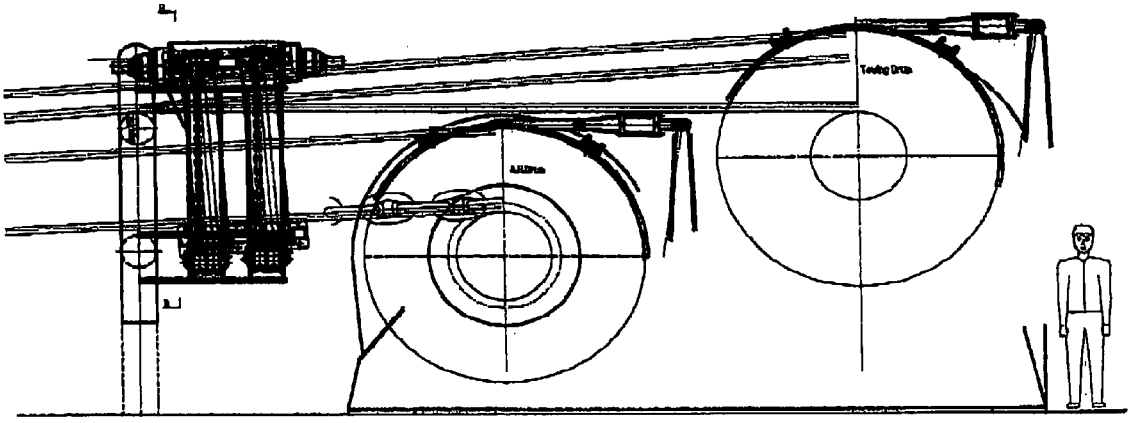
Figure 3B:
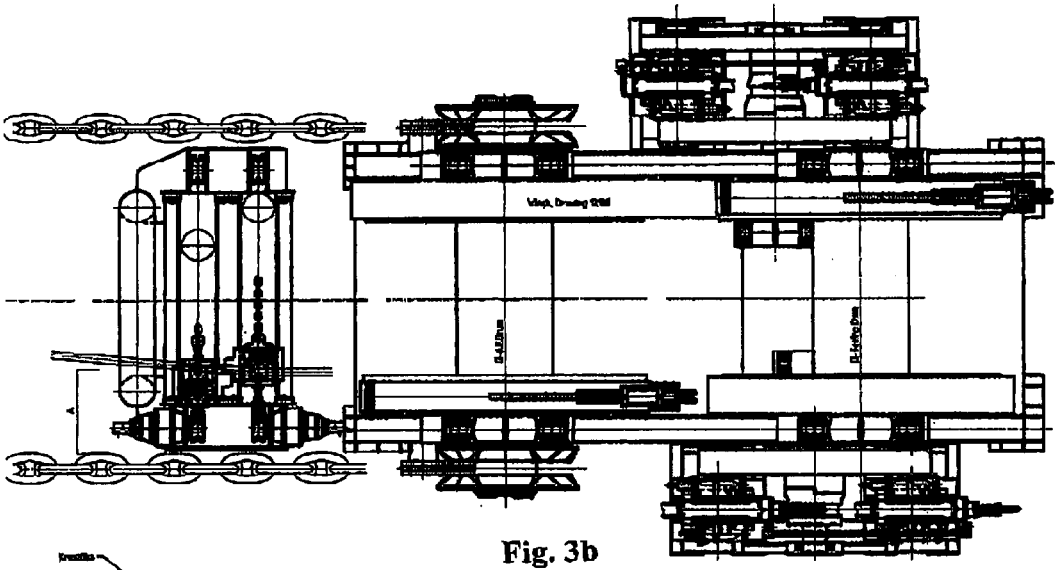
Figure 3C:
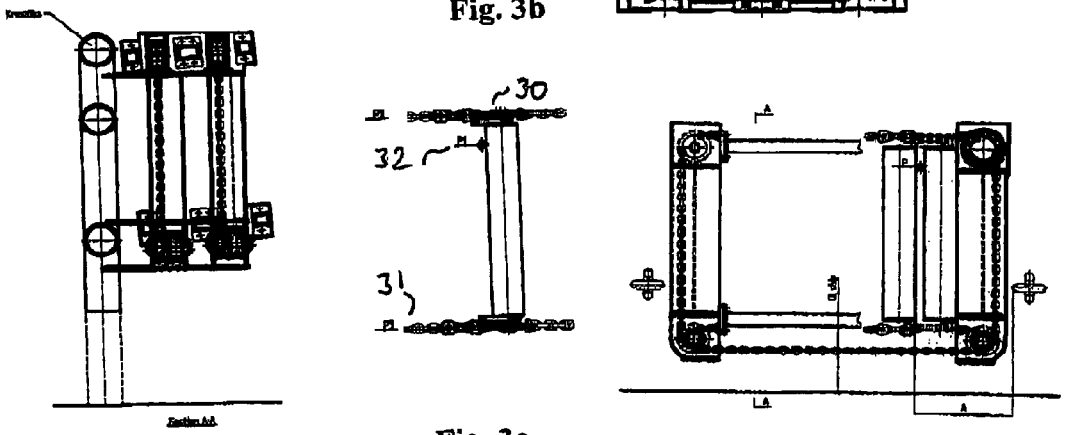

FIG. 3*a* depicts an example of embodiment of the present invention wherein two different cables, wires, ropes etc. are winched separately on to separate cable drums. FIG. 3*b* depicts the same arrangement as in FIG. 1, but viewed from the top. FIG. 3*c* illustrates how the main forces P1, P2 and P3, numerals 30, 31 and 32 is transferred to chains and bearings in each end of the cable drum assembly.

The invention claimed is:

1. Device for guiding cable, wire, rope, chain, string having a receiving side for winching orderly and layered cable, wire, rope, chain, string on to a cable drum comprising:

first and second movable driving lines, at least one guiding reel (2) having first and second sides respectively attached to the first and second driving lines (3,4) such that the guiding reel (2) is moved back and forth by the movable driving lines (3,4) above the receiving side of said device.

2. Device according to claim 1, including a mechanical axle (6) interconnected with said first and second driving lines (3,4) such that movement of the first side and the second side of said guiding reel (2) is coordinated.

3. Device according to claim 1, wherein said first and second driving lines (3,4) have separate driving units (5) comprising means for coordinating the movements of each of the first and second driving lines (3,4).

4. Device according to claim 3, wherein said first and second driving lines are two independent driving lines 3,4.

5. A winching apparatus incorporating the device according to claim 1.

6. Apparatus according to claim 5 comprising a plurality of the devices for guiding cables, wherein the plurality of the devices for guiding cables is arranged about each other in a row.

7. Apparatus according to claim 5 comprising a plurality of the devices for guiding cables, wherein the plurality of the devices for guiding cables is arranged about each other sideways.

* * * * *

UNITED STATES PATENT AND TRADEMARK OFFICE

CERTIFICATE OF CORRECTION

PATENT NO. : 7,143,972 B2
APPLICATION NO. : 10/860167
DATED : December 5, 2006
INVENTOR(S) : Steinar Finnøy It is certified that error appears in the above-identified patent and that said Letters Patent is hereby corrected as shown below:

Column 1
Line 31, change “tho” to --the--

Column 1
Line 42, change “round” to --found--

Column 1
Line 62, remove the word “in”

Signed and Sealed this

First Day of May, 2007

JON W. DUDAS
*Director of the United States Patent and Trademark Office*